US008827579B2

(12) United States Patent
Yajima et al.

(10) Patent No.: US 8,827,579 B2
(45) Date of Patent: Sep. 9, 2014

(54) GROUNDING STRUCTURE AND RECORDING APPARATUS

(75) Inventors: Yasushi Yajima, Minowa-machi (JP); Daisuke Hiruma, Matsumoto (JP); Ryo Hamano, Matsumoto (JP); Norihito Harada, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 13/219,432

(22) Filed: Aug. 26, 2011

(65) Prior Publication Data

US 2012/0051822 A1 Mar. 1, 2012

(30) Foreign Application Priority Data

Aug. 31, 2010 (JP) ..... 2010-193557

(51) Int. Cl.
*B41J 2/01* (2006.01)

(52) U.S. Cl.
USPC ..... 400/118.2; 347/20

(58) Field of Classification Search
USPC ..... 347/20; 400/118.2
See application file for complete search history.

(56) References Cited

U.S. PATENT DOCUMENTS

| | | | | |
|---|---|---|---|---|
| 2004/0109041 | A1 * | 6/2004 | Owaki et al. | 347/20 |
| 2008/0186692 | A1 | 8/2008 | Mayumi et al. | |
| 2010/0084854 | A1 * | 4/2010 | Sathyanarayana et al. | 285/84 |

FOREIGN PATENT DOCUMENTS

| | | | | |
|---|---|---|---|---|
| JP | 1-253998 | | 10/1989 | |
| JP | 2-003853 | | 1/1990 | |
| JP | 6-068310 | | 3/1993 | |
| JP | 10-064606 | | 3/1998 | |
| JP | 11291465 | A * | 10/1999 | B41J 2/01 |
| JP | 2000-168057 | | 6/2000 | |
| JP | 3093148 | U | 1/2003 | |
| JP | 2006-015531 | | 1/2006 | |
| JP | 2008-191433 | | 8/2008 | |
| JP | 2010131818 | A * | 6/2010 | B41J 2/01 |

* cited by examiner

*Primary Examiner* — Nguyen Ha
(74) *Attorney, Agent, or Firm* — Workman Nydegger

(57) ABSTRACT

A grounding structure achieves a conductive state between members by making contact with the members. One member includes a screw-shaped portion in at least part of the member, and the other member includes an anchoring portion that engages with the screw-shaped portion of the one member under a biasing force in an interlocked state.

6 Claims, 6 Drawing Sheets

GROUNDING STRUCTURE AND RECORDING APPARATUS

The entire disclosure of Japanese Patent Application No: 2010-193557, filed Aug. 31, 2010 is expressly incorporated by reference herein.

BACKGROUND

1. Technical Field

The present invention relates to grounding structures that achieve electrically grounded states by achieving conduction between members, and to recording apparatuses provided with such grounding structures.

2. Related Art

With a recording apparatus such as an ink jet printer, multiple nozzles for ejecting ink droplets are provided in a recording head that is attached to a carriage, and recording processes are carried out by ink droplets being ejected through the nozzles toward recording paper (a recording medium).

If, in such an ink jet printer, the recording head has a different potential from the printer housing, there are cases where the ink droplets ejected through the nozzles become charged and problems, such as where the ink droplets do not land on the recording paper in the desired locations, occur. In order to prevent this, grounding structures such as that disclosed in JP-A-1-253998 are employed, where the recording head is grounded to the printer housing in order to set the recording head to approximately the same potential as the printer itself. Grounding structures such as that disclosed in JP-A-1-253998 are also employed for various reasons in devices aside from recording apparatuses such as ink jet printers.

With the grounding structure according to JP-A-1-253998, an electrically grounded state is realized by a metal plate spring member that exhibits a biasing force being biased toward a metal member serving as the object to be grounded, thus bringing the plate spring member and the metal member into contact with each other.

Incidentally, however, with the grounding structure according to JP-A-1-253998, the metal member, serving as the object to be grounded, is grounded only as the result of a biasing force caused by the plate spring member in a single direction. Accordingly, there is a risk that the respective members will temporarily separate and an ungrounded state will result due to, for example, vibrations, impacts, and so on.

SUMMARY

It is an advantage of some aspects of the invention to provide a grounding structure that is capable of maintaining a stable grounded state, and to provide a recording apparatus that includes such a grounding structure.

A grounding structure according to an aspect of the invention is a grounding structure that achieves a conductive state between members by making contact with the members. One member includes a screw-shaped portion in at least part of the member, and the other member includes an anchoring portion that engages with the screw-shaped portion of the one member under a biasing force in an interlocked state.

According to this configuration, the anchoring portion of the other member enters into and engages with the screw-shaped portion of the one member while being biased, and thus movement of the anchoring portion can be suppressed by both the compressed state resulting from the biasing force and the engagement with the screw-shaped portion when the anchoring portion has entered into the screw-shaped portion, as compared to existing grounding structure configurations that operate under only the biasing force of a spring member. Accordingly, the contact state between the one member and the other member can be suppressed from being canceled even when subjected to vibrations, impacts, and so on, which makes it possible to maintain a stable grounded state.

In the grounding structure according to another aspect of the invention, it is preferable that the anchoring portion be configured so as to make contact with the screw-shaped portion at two or more points.

According to this configuration, the screw-shaped portion and the anchoring portion make contact at two or more points, and thus a more secure grounded state can be maintained.

In the grounding structure according to another aspect of the invention, it is preferable that the anchoring portion be configured so that torsion is generated along the direction in which the grooves are formed in the screw-shaped portion when the anchoring portion enters into the screw-shaped portion.

According to this configuration, because the anchoring portion is twisted along the groove formation direction of the screw-shaped portion by entering into the screw-shaped portion, it is possible to achieve a more secure grounded state.

In the grounding structure according to another aspect of the invention, it is preferable that the one member and the other member configure a transport member that moves along the transport direction, and it is preferable that the anchoring portion be configured so that the tip of the anchoring portion is formed in a dual-leg shape that encloses the screw-shaped portion in the transport direction.

According to this configuration, because the tip in the other member is the dual-leg shape anchoring portion that makes contact with the screw-shaped portion in the one member by making contact with the screw-shaped portion on both sides thereof in the transport direction of the transport member, the anchoring portion and the screw-shaped portion can be brought into contact with each other with certainty, even when the transport member is moving in the transport direction; this makes it possible to maintain the grounded state more securely.

A recording apparatus according to another aspect of the invention includes: a recording unit that carries out a recording process on a recording medium while the recording unit is supported on a transport member that moves along a transport direction; and the grounding structure configured as described above, for grounding the recording unit.

According to this configuration, it is possible to provide a recording apparatus capable of achieving the same effects as the aforementioned grounding structure.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
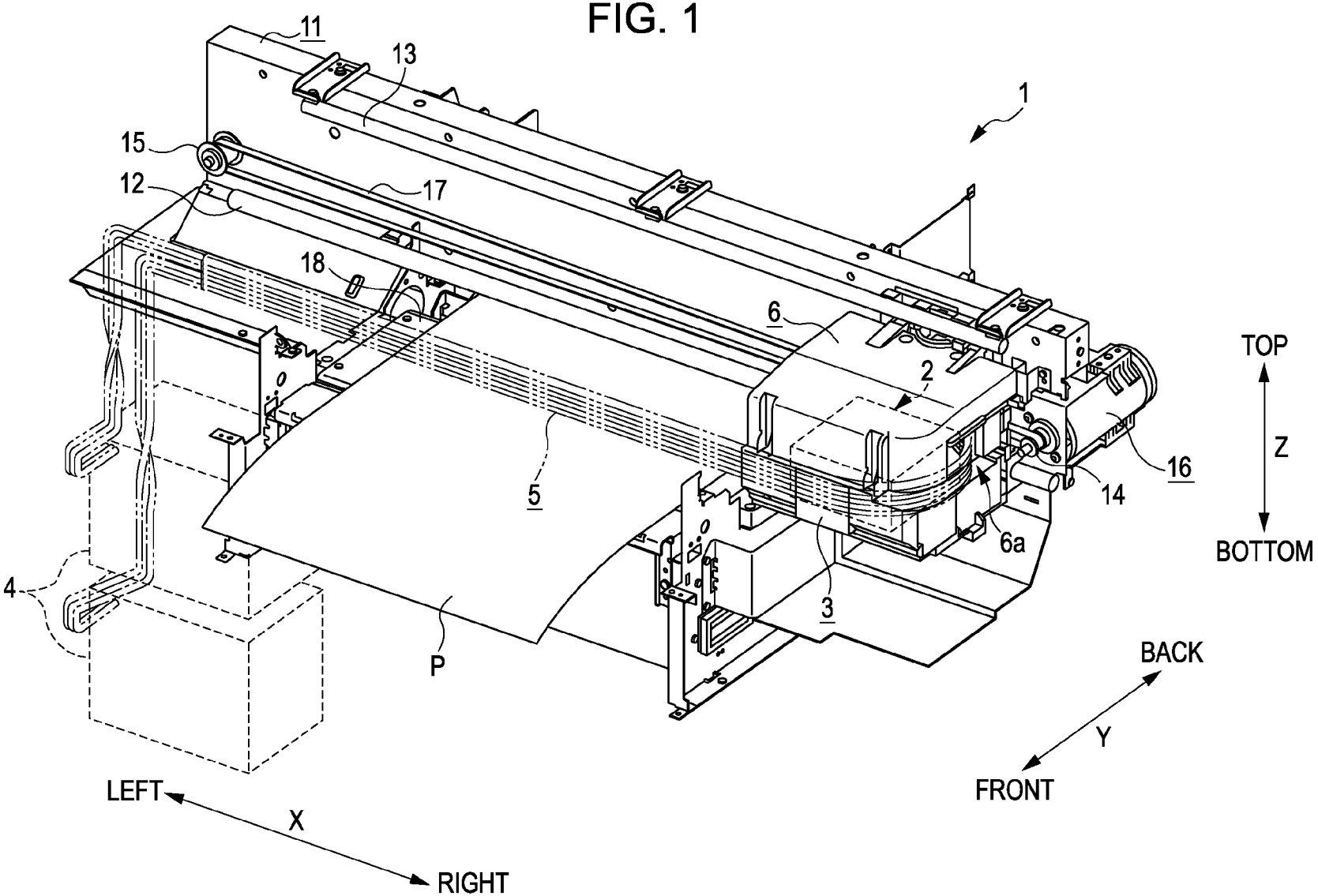
FIG. 1 is an overall perspective view illustrating a printer according to an embodiment.

Hereinafter, a specific embodiment of an ink jet printer (also called simply a "printer" hereinafter), serving as a type of a recording apparatus according to the invention, will be described with reference to FIGS. 1 through 5C. Note that in the following descriptions, "horizontal direction", "depth direction", and "vertical direction" refer to the horizontal direction, depth direction, and vertical direction, respectively, indicated by the arrows in the drawings, unless expressly mentioned otherwise. Furthermore, the "horizontal direction" in this case corresponds to a main scanning direction, which is the movement direction of a recording unit that is supported by a transport member; the "depth direction" corresponds to a sub scanning direction, which is the transport direction of a recording medium; and the "vertical direction" is simply a vertical direction.

As shown in FIG. 1, a printer 1 serving as a recording apparatus includes recording heads 2, serving as liquid ejecting heads that eject ink (a liquid) onto recording paper P (a recording medium), and a carriage 3, in which the recording heads 2 are mounted and that moves back and forth in the horizontal direction X. In other words, the recording heads 2 move in the horizontal direction X along with the carriage 3 within a frame 11 with which the printer 1 is provided.

A main guide shaft 12 and a sub guide shaft 13 are provided within the frame 11, which extends so that the lengthwise direction of its box-shaped form follows the horizontal direction X. These guide shafts 12 and 13 serve as shaft members that extend in the horizontal direction X, and the carriage 3 is supported by the frame 11 through these guide shafts 12 and 13.

In addition, a driving pulley 14 and a slave pulley 15 are provided, in freely-rotatable states, in positions that correspond to both ends of the horizontal direction X of the main guide shaft 12 in the frame 11. An electric motor 16 serving as a driving source is connected to the driving pulley 14, and a timing belt 17 that is affixed to the carriage 3 is stretched between the pulleys 14 and 15. The carriage 3 thus moves back and forth in the horizontal direction X due to the driving of the electric motor 16 while being guided by the guide shafts 12 and 13. Note that in this embodiment, a transport unit that moves the carriage 3, which is an example of the transport member, along the guide shafts 12 and 13 is configured by the driving pulley 14, the slave pulley 15, the electric motor 16, and the timing belt 17.

Meanwhile, a support member 18 that supports the recording paper P is provided so as to extend below the main guide shaft 12. The recording paper P is transported toward the front by a paper feed mechanism (not shown) included in the printer 1, and is fed along the top surface of the support member 18, as shown in FIG. 1.

The printer 1, which is what is known as an "off-carriage" type in which ink tanks are not provided upon the carriage 3, includes ink tanks 4 provided in fixed locations outside of the carriage 3, and flexible ink supply tubes 5 that supply ink to the recording heads 2 supported by the carriage 3 from the ink tanks 4. It is desirable for the ink tanks 4 to be configured of replaceable ink cartridges, from the standpoint of the ease of maintenance.

The ink tanks 4 have multiple ink holding spaces for holding multiple colors of ink. Meanwhile, the ink supply tubes 5 are provided with multiple ink supply channels for supplying inks of the respective colors based on the multiple colors of ink that are supplied from the ink tanks 4 to the recording heads 2.

When printing onto the recording paper P, ink is supplied from the ink tanks 4 to the recording heads 2 via the ink supply tubes 5. The recording heads 2 then eject ink onto the recording paper P through multiple nozzles (not shown) provided on the bottom surfaces of the recording heads 2. At this time, the recording heads 2 record a two-dimensional image onto the recording paper P by the carriage 3 moving in the horizontal direction X, which is the main scanning direction, while the recording paper P is sequentially transported in the depth direction Y, which is the sub scanning direction.

Next, the carriage 3, and a grounding structure provided in the carriage 3, will be described in detail.

As shown in FIG. 1, a carriage cover 6 is provided on the upper portion of the carriage 3 so as to cover the interior of the carriage 3. A tube insertion portion 6*a* into which the ink supply tubes 5 are inserted is provided in the carriage cover 6. The tube insertion portion 6*a* is an opening for leading the ink supply tubes 5 into the carriage 3 that is covered by the carriage cover 6.

Figure 2:
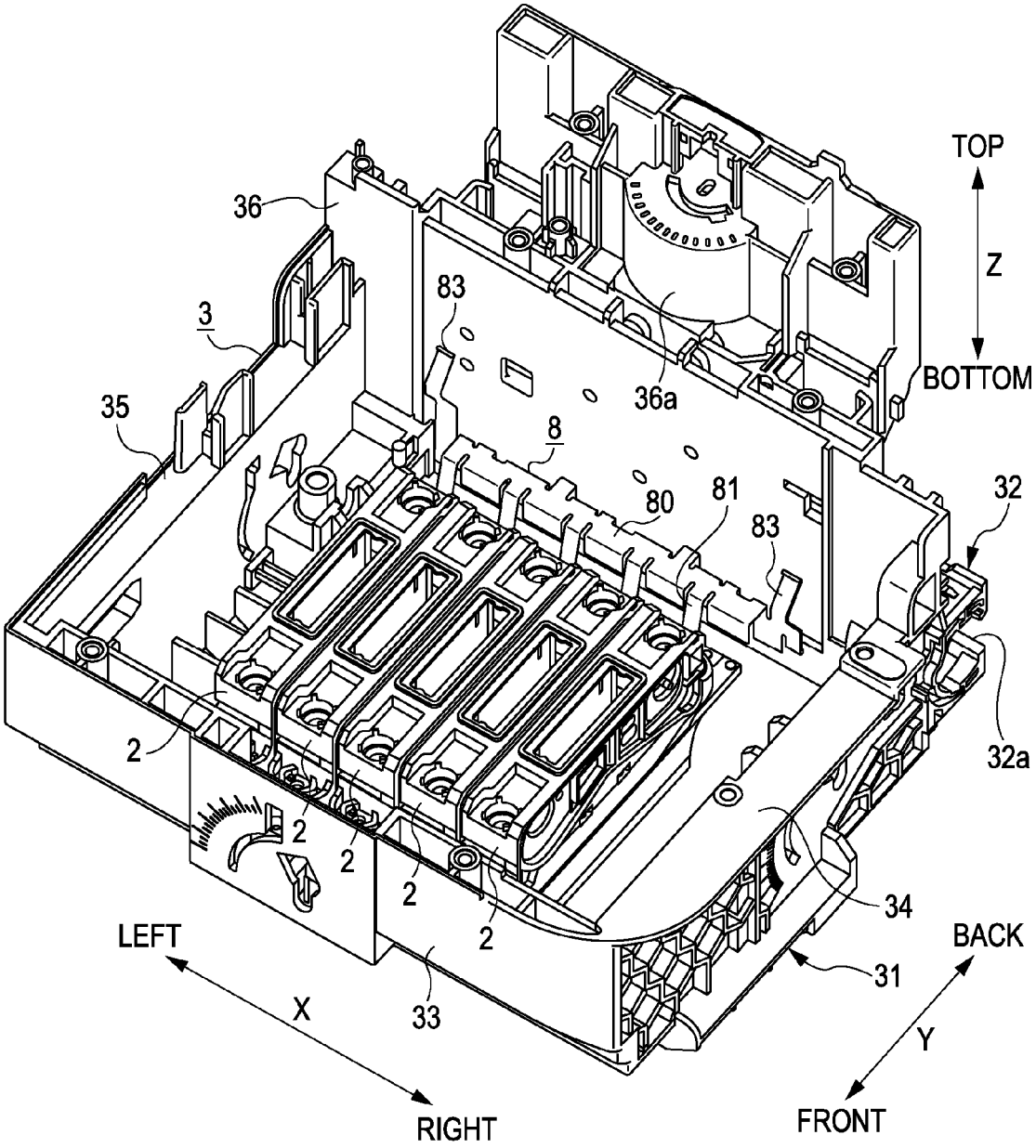
FIG. 2 is a perspective view illustrating a carriage.
Figure 3A:
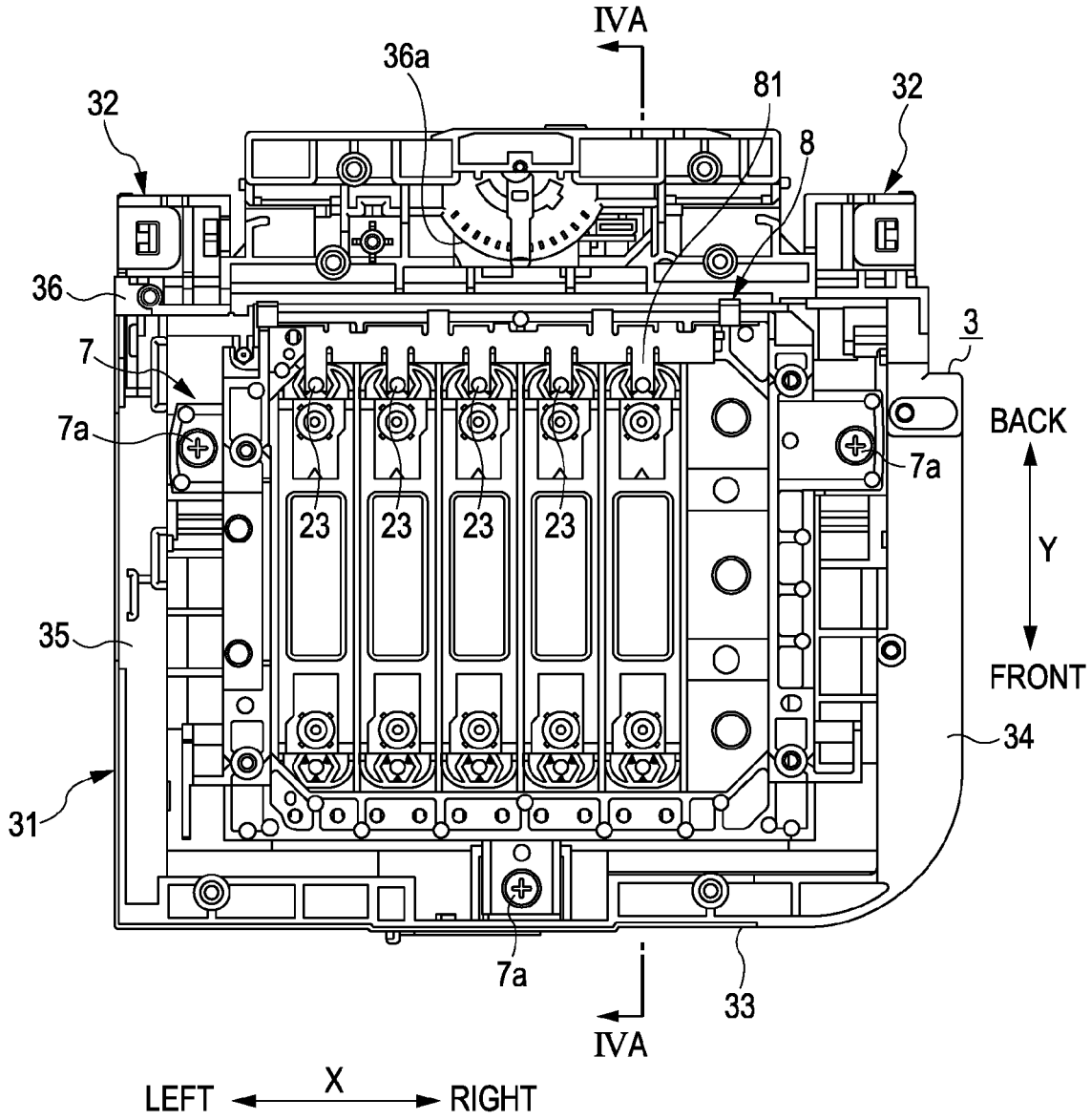
FIG. 3A is a plan view illustrating the carriage.
Figure 3B:
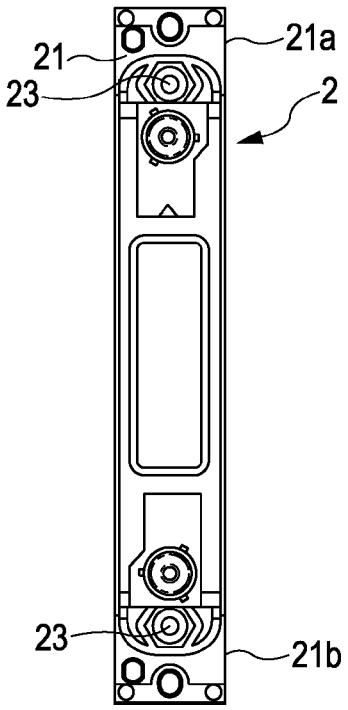
FIG. 3B is a plan view illustrating a recording head.
Figure 3C:
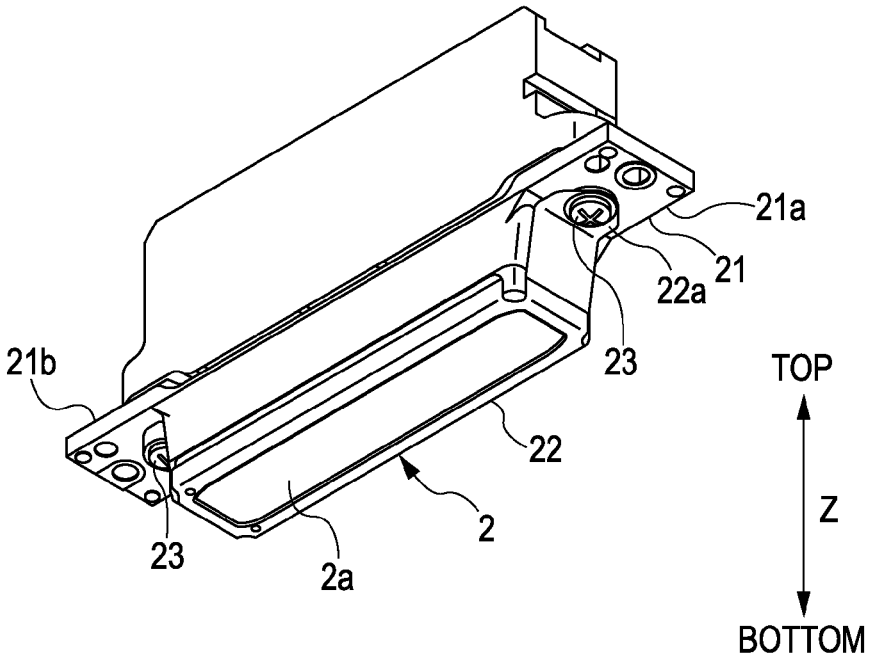
FIG. 3C is a perspective view illustrating the recording head seen from below.

FIG. 2 is a perspective view illustrating a state in which the carriage cover 6 and a sub carriage 7 have been removed from the carriage 3 shown in FIG. 1. FIG. 3A is a plan view illustrating a state in which the sub carriage 7 has been added to the content shown in FIG. 2, whereas FIG. 3B is a plan view illustrating the one of the recording heads 2 and FIG. 3C is a perspective view illustrating the one of the recording heads 2.

As shown in FIG. 2, the carriage 3 includes a rectangular box-shaped main body unit 31 that is open on the top and bottom, and shaft attachment portions 32, provided on one of the four outer surfaces of the main body unit 31, that are used when attaching the carriage 3 to the main guide shaft 12 (see FIG. 1).

The main body unit 31 of the carriage 3 includes: a front wall 33 that extends in the horizontal direction X; a right wall 34 that connects to the right end of the front wall 33 and extends backward from the front wall 33; a left wall 35 that connects to the left end of the front wall 33 and extends backward from the front wall 33; and a back wall 36 that extends in the horizontal direction X from the respective ends of the right and left walls 34 and 35. A sliding portion 36*a*, which has an arc shape when viewed from above, is provided on the top of the back wall 36; the sub guide shaft 13 (see FIG. 1) slides on the sliding portion 36*a* from the front.

The shaft attachment portions 32 are provided on the back end of the main body unit 31. Specifically, as shown in FIGS. 3A through 3C, the shaft attachment portions 32 are provided on the respective ends of the right wall 34 and the left wall 35. Insertion openings 32*a* (see FIG. 2), into which the main guide shaft 12 is inserted and which open in the rear direction, are formed in each of the shaft attachment portions 32.

As shown in FIG. 2, a rectangular opening is configured in the main body unit 31 of the carriage 3 by the walls 33 to 36. This opening is an opening through which the carriage 3 passes in the vertical direction Z, and is formed so as to be approximately square in shape when viewed from above. The sub carriage 7, whose position can be adjusted relative to the carriage 3, is provided in this opening that is provided in the main body unit 31. As shown in FIG. 3A, the sub carriage 7 is affixed within the carriage 3 using screws 7*a*.

The sub carriage 7 is formed in a square box shape with an opening that passes therethrough in the vertical direction Z, like the carriage 3. The recording heads 2 that eject ink downward (see FIG. 4) are mounted within this opening of the sub carriage 7. Multiple recording heads 2 (in this embodiment, five) are provided, corresponding to each color of ink supplied through the ink supply tubes 5. The configuration is such that each of the recording heads 2 is affixed to the sub carriage 7 by screws and is anchored to the carriage 3 via the sub carriage 7.

As shown in FIG. 3C, each of the recording heads 2 includes a nozzle plate 21 on its lower side. A nozzle cover 22 is attached to a lower portion of the nozzle plate 21. Tab-shaped attachment arm portions 21*a* and 21*b*, which respectively protrude in the horizontal direction, are provided in each nozzle plate 21 of the recording heads 2, on one end and the other end, respectively, in the lengthwise direction of the nozzle plate 21.

The nozzle cover 22 is a member that protects a nozzle formation surface 2*a* in which the nozzles (not shown) of each of the recording heads 2 are formed by covering the peripheral edges of the nozzle formation surface 2*a*, and is used to adjust the potential of the nozzle formation surface 2*a* to the ground potential. The nozzle cover 22 is formed by processing a conductive metal plate configured of an extremely thin piece of stainless steel or the like. The nozzle cover 22 includes attachment tabs 22*a* on one end and the other end, respectively, of the lengthwise direction thereof, the attachment tabs 22*a* being tab-shaped and protruding less than the attachment arm portions 21*a* and 21*b* of the nozzle plate 21. Attachment holes (not shown) are formed in each of the attachment tabs 22*a*.

Figure 4A:
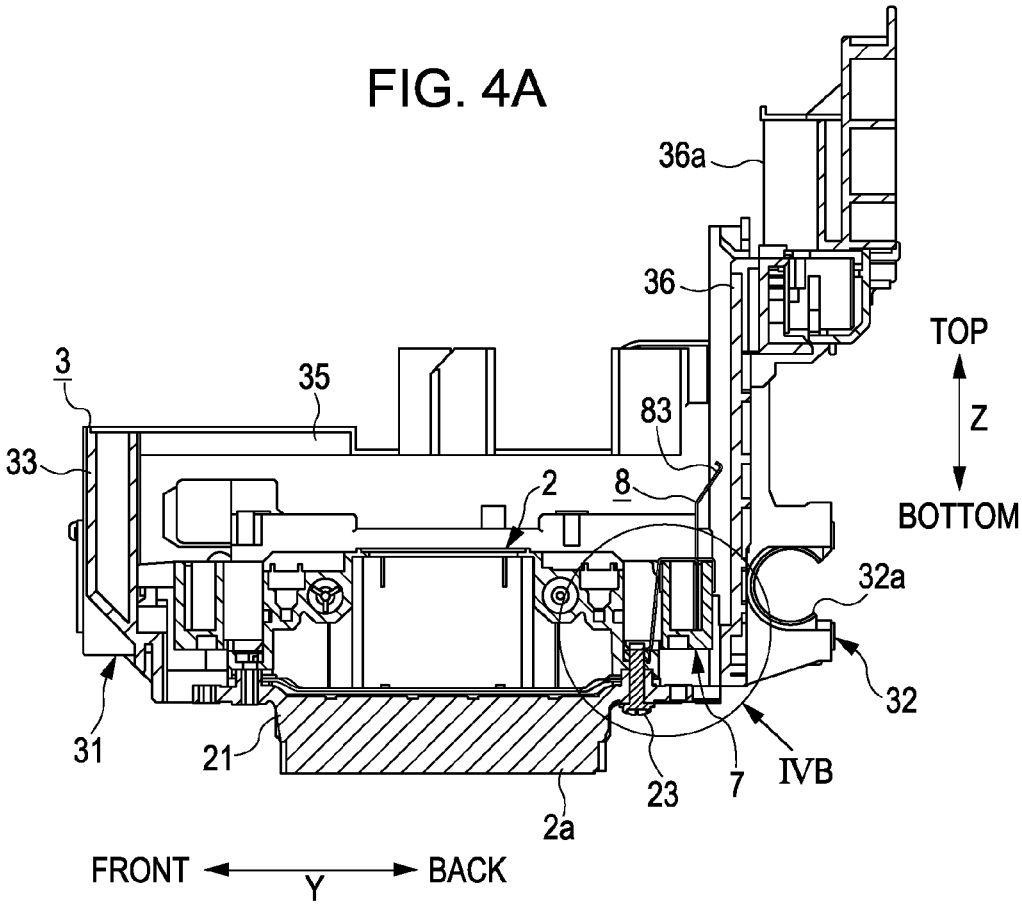
FIG. 4A is a cross-sectional view illustrating the carriage.
Figure 4B:
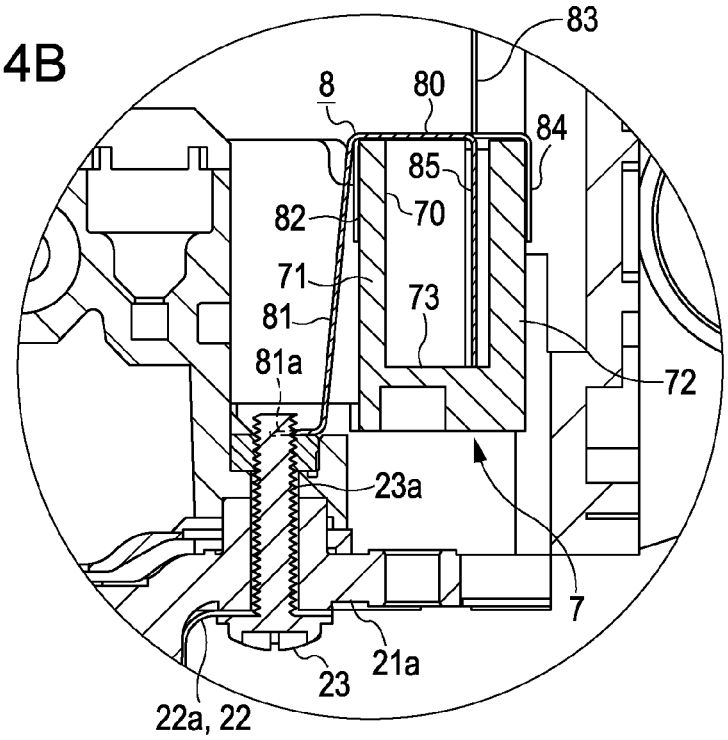
FIG. 4B is an enlarged cross-sectional view illustrating the principle elements of the carriage.

Through-holes (not shown) for anchoring the nozzle cover 22 using screws are provided in the attachment arm portions 21*a* and 21*b* of the nozzle plate 21 in positions that respectively correspond to the attachment holes formed in the attachment tabs 22*a* of the nozzle cover 22. The inner circumferential surface of each through-hole is tapped so that a cover attachment screw 23 can be threaded into the through-hole. The nozzle cover 22 is screwed down onto the attachment arm portions 21*a* and 21*b* of the nozzle plate 21 using the cover attachment screws 23 from the outer side (that is, from the side of the nozzle formation surface 2*a*). At this time, a metal washer or the like may be provided between the back side of the head of each cover attachment screw 23 and the nozzle cover 22. The cover attachment screw 23 is a screw that is formed of a metal (that is, an electrical conductor). When the nozzle cover 22 is attached to the recording head 2, the tips of the cover attachment screws 23 (that is, the upper ends in FIGS. 4A and 4B) protrude as far as the area that faces the inner side of the carriage 3, as shown in FIGS. 4A and 4B. In other words, when the nozzle cover 22 is attached to the nozzle plate 21, the cover attachment screws 23 pass into the carriage 3 from the outside.

Meanwhile, a grounding member 8 (see FIGS. 5A through 5C) is provided in the carriage 3 for putting the cover attachment screws 23 and the recording head 2 into an electrically grounded state by achieving electrical continuity between the housing frame (not shown) of the printer 1, which is on the side of the main guide shaft 12 when viewed from the recording heads 2, and the cover attachment screws 23. Note that in this embodiment, in a grounding structure that achieves a conductive state by bringing members into contact with each other, the cover attachment screws 23 correspond to one of the members, whereas the grounding member 8 corresponds to the other of the members.

The grounding member 8 is formed by processing a single metal plate (an electrical conductor). As shown in FIGS. 3A through 4B, the grounding member 8 includes a base portion 80 that extends in the horizontal direction X, or in other words, the main scanning direction, when installed within the carriage 3.

Figure 5A:
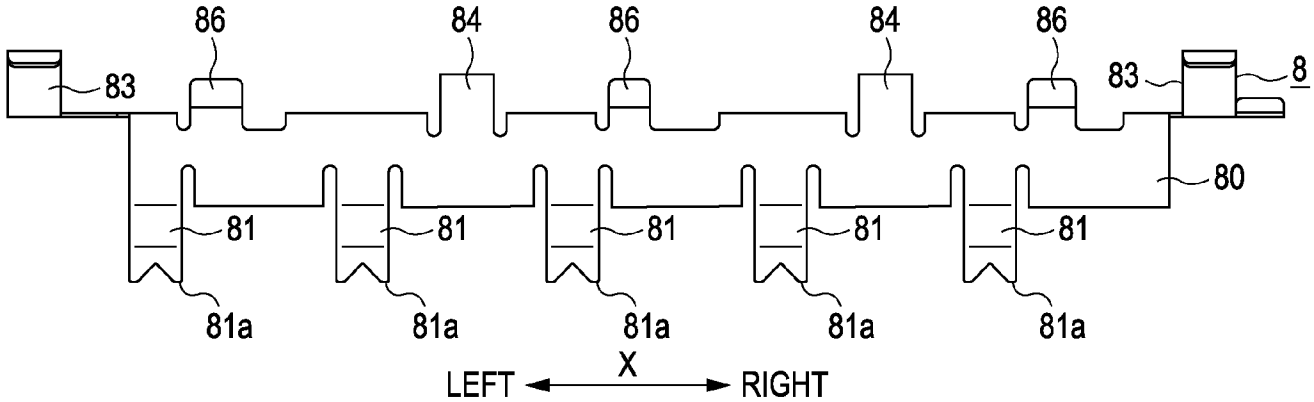
FIG. 5A is a plan view illustrating a grounding member.
Figure 5B:
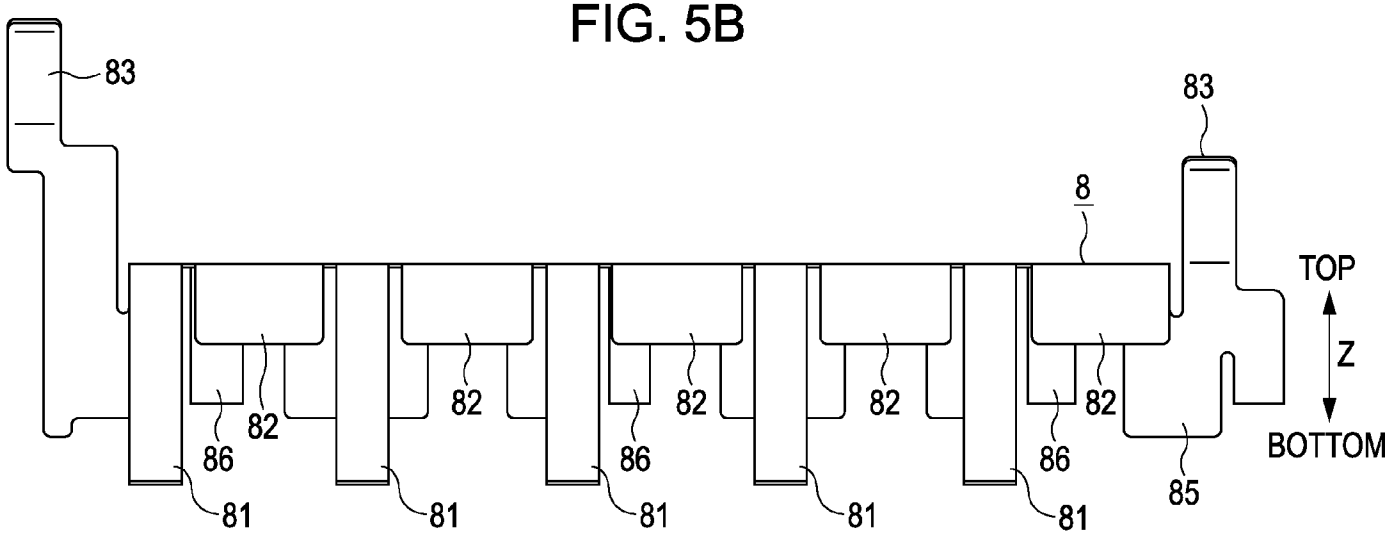
FIG. 5B is a front view illustrating the grounding member.
Figure 5C:
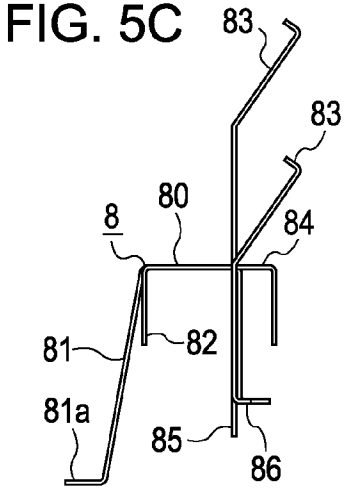
FIG. 5C is a right-side view illustrating the grounding member.

As shown in FIG. 5A, multiple (in this embodiment, five) anchoring portions 81 that respectively correspond to the cover attachment screws 23 for screwing down the nozzle plates 21 and nozzle covers 22 to their corresponding recording heads 2, and multiple (in this embodiment, five) first extension portions 82, extend in an alternating manner in the horizontal direction X from the front end of the base portion 80.

The anchoring portions 81 extend in a direction that intersects with the extension direction (the vertical direction Z) of the first extension portions 82, which extend in the direction that is orthogonal to the plate-shaped base portion 80, and a direction that intersects, non-vertically, with the base portion 80, and include anchoring sections 81*a* that are formed by the ends of the anchoring portions 81 being bent so as to extend forward. The tips of the anchoring sections 81*a* have a dual-leg shape that forms an approximately V shape, and the thickness of the tips is set to be at or less than the groove width of screw grooves (screw-shape portions) 23*a* formed in a threaded form in the cover attachment screws 23; thus the anchoring sections 81*a* can enter into the screw grooves 23*a*. In addition, the anchoring sections 81*a* are configured so as to be capable of making contact with the cover attachment screws 23 with the dual-leg shape thereof engaging with the cover attachment screws 23 in a sandwiching manner. Accordingly, the anchoring sections 81*a* and the cover attachment screws 23 make contact with each other at two points in the horizontal direction X.

As shown in FIGS. 4A and 4B, the first extension portions 82 make contact with the front surface of a front wall 71 of an anchoring target member 70, which has a cross-sectional U-shape and stands erect from the rear area of the sub carriage 7, in the depth direction Y.

On the other hand, as shown in FIG. 4B and FIGS. 5A through 5C, two connection portions 83 extend in a direction that is approximately opposite to the extension direction of the anchoring portions 81, extending from the back ends of both ends of the base portion 80 in the lengthwise direction (horizontal direction). These two connection portions 83 are electrically connected to the main guide shaft 12 by making contact with conductive plate-shaped members (not shown) that are electrically connected to the main guide shaft 12 and are provided extending along the inner surface of the back wall 36 of the carriage 3.

Furthermore, a second extension portion 84 that makes contact with a back wall 72 of the anchoring target member 70, a third extension portion 85 that makes contact with an inner base portion 73 of the anchoring target member 70, and a fourth extension portion 86 that makes contact in the vertical direction Z with the inner surface of a concave groove (not shown) provided on the inner surface of the back wall 72, are provided from the rear end of the base portion 80.

With the grounding member 8 configured as described above, the first extension portions 82 and the second extension portion 84 of the grounding member 8 make contact with the front wall 71 and the back wall 72 of the anchoring target member 70, which has a cross-sectional U shape, that stand erect at the rear area of the sub carriage 7, so as to enclose the anchoring target member 70 in a sandwiching manner in the depth direction Y, and thus the movement of the grounding member 8 in the depth direction Y is restricted. In addition, the movement of the grounding member 8 in the vertical direction Z is restricted by the third extension portion 85, which makes contact with the inner base portion 73 of the anchoring target member 70, the base portion 80, which makes contact with the upper ends of the side walls 71 and 72, and the fourth extension portion 86, which makes contact with the inner surface of the concave groove of the back side wall 72 of the grounding member 8 in the vertical direction Z. Furthermore, because the tips of the anchoring sections 81*a* of the anchoring portions 81 have a dual-leg shape and are configured so as to engage with the cover attachment screws 23 in a sandwiching manner in the horizontal direction X, the movement of the grounding member 8 in the horizontal direction X, which is the transport direction of the carriage 3, is restricted as well.

This grounding member 8 is directly connected to the main guide shaft 12 attached to the shaft attachment portions 32 of the carriage 3 or is connected to the main guide shaft 12 via another conductive member, and the main guide shaft 12 is directly connected to the housing frame of the printer 1 or is connected to the housing frame via another metal member (conductor). Accordingly, the recording heads 2 (nozzle covers 22) are grounded to the housing frame of the printer 1 via the grounding member 8 and the cover attachment screws 23, making it possible to favorably suppress the vicinity of the nozzle formation surfaces 2*a* from becoming charged. At this time, the anchoring sections 81*a* of the grounding member 8 are biased so as to be compressed and contacted toward the screw grooves 23*a* of the cover attachment screws 23, under a biasing force based on the elastic deformation of the anchoring sections 81*a* (anchoring portions 81) themselves, which suppresses the grounded state from being canceled. In addition, the tips of the anchoring sections 81*a* are configured so as to enter in accordance with torsional deformation along the formation direction of the screw grooves 23*a* that are formed in a threaded shape, and press against the inner surface of the screw grooves 23*a* under the restorative force under which the anchoring sections 81*a* themselves attempt to return to their original shapes when the anchoring sections 81*a* have entered and are engaged; thus a more secure state of grounding can be achieved. Furthermore, because the movement of the anchoring sections 81*a* in the vertical direction Z is also restricted, as mentioned earlier, by the screw grooves 23*a* of the cover attachment screws 23, the grounded state is suppressed from being canceled.

According to the embodiment described thus far, the following effects can be achieved.

1. Because the anchoring sections 81*a* of the grounding member 8 are biased so as to enter into and engage with the screw grooves 23*a* of the cover attachment screws 23, movement of the anchoring sections 81*a* can be suppressed by both the compressed state resulting from the biasing force and the engagement between the screws 23 and the screw grooves 23*a* when the anchoring sections 81*a* have entered into the screw grooves 23*a*, as compared to existing grounding structure configurations that operate under only the biasing force of a spring member. Accordingly, the contact state (grounded state) between the respective members (the screws 23 and the grounding member 8) can be suppressed from being canceled even when subjected to vibrations, impacts, and so on, which makes it possible to maintain a stable grounded state.

2. By configuring the shape of the anchoring sections 81*a* as an approximately V shape that engages with the cover attachment screws 23 in a sandwiching manner, the anchoring sections 81*a* and the screws 23 make contact at two or more points; this makes it possible to ensure a more secure state of contact between the screws 23 and the grounding member 8, and makes it possible to maintain the grounded state of the recording heads 2.

3. Because the anchoring sections 81*a* are twisted along the groove formation direction of the screw grooves 23*a* by entering into the screw grooves 23*a* of the cover attachment screws 23, it is possible to achieve a more secure grounded state.

4. Because the tips in the grounding member 8 are the dual-leg shape anchoring sections 81*a* that make contact with the screw grooves 23*a* in the cover attachment screws 23 by making contact with the cover attachment screws 23 in a sandwiching manner on both sides thereof in the transport direction of the carriage 3, the anchoring sections 81*a* and the screws 23 can be brought into contact with each other securely, even when the carriage 3 is moving in the transport direction; this makes it possible to maintain the grounded state more securely.

Note that the aforementioned embodiment may be modified as described hereinafter.

Although the tip shape of the anchoring sections 81*a* of the grounding member 8, which engage with the screw grooves 23*a* of the cover attachment screws 23, is described in the aforementioned embodiment as being an approximately V shape, the invention is not limited thereto, and another dual-leg shape, such as an approximately U shape, may be employed instead.

Although the tip shape of the anchoring sections 81*a* is described in the aforementioned embodiment as being a dual-leg shape, the invention is not limited thereto, and the tip of the anchoring sections 81*a* may be a shape aside from a dual-leg shape, such as a simple rectangular shape. Even with such a configuration, the movement in the vertical direction Z is restricted by the screw grooves 23*a*, by the anchoring sections 81*a* entering into the screw grooves 23*a* of the cover attachment screws 23 under the biasing force toward the screws 23 based on the elastic deformation of the anchoring sections 81*a* themselves. Accordingly, a more secure grounded state can be achieved, as compared to a grounding structure that operates under the biasing force alone.

Although the aforementioned embodiment describes a structure in which the anchoring sections 81*a* enter in a sloped state so that the attachment direction of the anchoring sections 81*a* of the grounding member 8 intersects with the formation direction of the screw grooves 23*a* of the cover attachment screws 23 at a predetermined angle, the configuration may be such that the anchoring sections 81*a* of the grounding member 8 are attached in advance along the formation direction of the screw grooves 23*a* of the cover attachment screws 23. In addition, the screw grooves 23*a* are not limited to covering the entire shaft direction of the shafts of the cover attachment screws 23, and may be formed in a part of the outer circumferential surface thereof that corresponds to the anchoring sections 81*a* of the grounding member 8, in the shaft direction.

In the above embodiment, the recording apparatus is embodied as the ink jet printer 1, but a liquid ejecting apparatus that ejects or expels another liquid aside from ink may be employed as well. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind.

Furthermore, the "liquid" referred to here can be any material capable of being ejected by the liquid ejecting apparatus. For example, any matter can be used as long as the matter is in its liquid state, including liquids having high or low viscosity; fluids such as sol, gel water, other inorganic or organic agents, liquid solutions, liquid resins, and liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier, as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these liquid ejecting apparatuses.

Although the ink jet printer 1 is described in the aforementioned embodiment, a grounding structure such as that described above may be employed in other electric apparatuses or other items that require grounding.

What is claimed is:

1. A grounding structure that achieves a conductive state between members by making contact with the members, the grounding structure comprising:

a base member that extends in a depth direction;

an anchoring portion extending from the base member in a first direction that intersects the base member non-vertically;

a plurality of extension portions extending from the base member, the plurality of extension portions arranged to restrict movement of the grounding structure in the depth direction and in a first direction that is vertical to the depth direction;

a first member having a screw-shaped portion; and an anchoring target member, wherein the anchoring portion is configured to engage with the first member under a biasing force in an interlocked state, wherein the plurality of extension portions are configured to contact with the anchoring target member, and the anchoring target member is located between the plurality of extension portions in the first direction.

2. The grounding structure according to claim 1, wherein the anchoring portion is configured so as to make contact with the screw-shaped portion at two or more points.

3. The grounding structure according to claim 1, wherein the anchoring portion is configured so that torsion is generated along the direction in which grooves are formed in the screw-shaped portion when the anchoring portion enters into the screw-shaped portion.

4. The grounding structure according to claim 1, wherein the first member and a second member are included in a transport member that moves along a transport direction; and the anchoring portion is configured so that a tip of the anchoring portion is formed in a dual-leg shape that encloses the screw-shaped portion in a sandwiching manner in the transport direction.

5. A recording apparatus comprising:

a recording unit that carries out a recording process on a recording medium while the recording unit is supported on a transport member that moves along a transport direction; and the grounding structure according to claim 1, for grounding the recording unit.

6. The grounding structure according to claim 1, wherein the plurality of extension portions includes a first extension portion extending vertically from the base member and a second extension portion extending vertically from the base member, the first extension portion is located more closely to the anchoring portion rather than the second extension portion in the in the first direction, wherein a length of the first extension portion in a second direction that is vertical to the first direction and the depth direction is longer than a length of the second extension portion in the second direction.

* * * * *